US005173385A

United States Patent [19]

Nozomi et al.

[11] Patent Number: 5,173,385

[45] Date of Patent: Dec. 22, 1992

[54] PHOTOSENSITIVE MEMBER FOR ELECTROPHOTOGRAPHY WITH COPOLYAMIDE INTERLAYER

[75] Inventors: Mamoru Nozomi; Kiyoshi Sekihara; Ryoko Aso, all of Kanagawa, Japan

[73] Assignee: Mitsubishi Kasei Corporation, Tokyo, Japan

[21] Appl. No.: 706,189

[22] Filed: May 28, 1991

[30] Foreign Application Priority Data

May 28, 1990 [JP] Japan ..... 2-137610

[51] Int. Cl.[5] ..... G03G 5/14

[52] U.S. Cl. ..... 430/59; 430/58; 430/60; 430/63; 430/64

[58] Field of Search ..... 430/58, 59, 60, 63, 430/64

[56] References Cited

U.S. PATENT DOCUMENTS

| | | | |
|---|---|---|---|
| 3,634,079 | 1/1972 | Champ et al. | 430/64 X |
| 4,377,629 | 3/1983 | Tarumi et al. | 430/63 X |
| 4,495,263 | 1/1985 | VanderValk | 430/60 |
| 5,071,723 | 12/1991 | Koyama et al. | 430/64 X |
| 5,075,189 | 12/1991 | Ichino et al. | 430/60 X |
| 5,104,757 | 4/1992 | Koyama et al. | 430/64 X |

FOREIGN PATENT DOCUMENTS

| | | | |
|---|---|---|---|
| 202449 | 10/1985 | Japan | 430/60 |
| 101853 | 5/1988 | Japan | 430/60 |

*Primary Examiner*—Ronald Martin

*Attorney, Agent, or Firm*—Oblon, Spivak, McClelland, Maier & Neustadt

[57] ABSTRACT

In the field of the photosensitive member for electrophotography comprising an electrically conductive substrate and at least one primer layer and a photosensitive layer, there is disclosed an improved member which is characterized in that the primer layer contains a copolyamide which contains as a constituent a diamine represented by a chemical formula

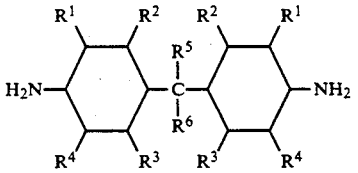

(I)

wherein $R^1$, $R^2$, $R^3$, $R^4$, $R^5$ and $R^6$ respectively and independently a hydrogen atom or a methyl or ethyl group.

13 Claims, No Drawings

PHOTOSENSITIVE MEMBER FOR ELECTROPHOTOGRAPHY WITH COPOLYAMIDE INTERLAYER

FIELD OF THE INVENTION

The present invention relates to a photosensitive member for electrophotography. More particularly, this invention relates to a photosensitive member having a specific primer layer.

BACKGROUND OF THE INVENTION

Electrophotography is widely used not only in the field of copying machines but also for various kinds of printers in recent years because of its instantaneity and high quality of produced image. For the photosensitive member, which constitutes a core of the electrophotography, photoconductive materials such as selenium, arsenic-selenium alloy, cadmium sulfide, zinc oxide, etc. conventionally have been used. Recently, organic photoconductive materials have now been developed because of their advantage that they can be produced easily without causing environmental pollution and also can be easily formed into films.

Of the organic photosensitive members, the so-called laminated photosensitive member, which comprises a charge generation layer and a charge transport layer, have a potential of becoming a mainstream of the photosensitive member, because highly sensitive photosensitive members can be obtained by combining an effective charge-generation material and an effective charge transport material, photosensitive members having high physiological safety can be produced by selecting materials from a wide range of materials, the productivity in coating is high and they can be produced rather economically. Therefore, the development thereof is very actively being conducted today.

The photosensitive member for electrophotography is generally manufactured by providing a photosensitive layer on a substrate such as aluminum. The conditions of the substrate surface considerably influences the produced image in the practical use of the electrophotographic process. For instance, stain, foreign materials and flaws existing on the surface remarkably influence electric characteristic of the photosensitive layer and cause defects in the produced image. In order to remove such surface defects, secondary processing such as machining , technique of mirror polishing, etc. as well as precise scouring, etc. are employed. However, these processings increase the manufacturing cost.

Also as a technique for obtaining a uniform and clean substrate surface, it is known to provide a primer layer between a substrate and a photosensitive layer. Examples of the primer layer are inorganic layers such as anodized aluminum oxide film, layer of aluminum oxide, aluminum hydroxide, etc. and organic layers such as those of poly(vinyl alcohol), caseine, polyvinylpyrrolidone, poly(acrylic acid), celluloses, gelatin, starch, polyurethane, polyimides, polyamides, etc.

The primary requirement for the primer layer is that it has no adverse influence on the electrophotographic characteristics. For that purpose, the primer materials must have low electric resistance and do not undergo remarkable change in electric resistance by environmental change.

Secondly, the primer layer must be free from injection of charge carriers into the photosensitive layer. The primer layer having carrier injection property decreases the charge acceptance of the photosensitive layer, which eventually reduces the contrast in the produced image or causes fogging.

Thirdly, the primer layer must be able to be formed as thickly as possible within the range in which the electric properties of the photosensitive layer are not impaired, since it must cover various defects of the substrate surface. Further, when the primer layer is formed by application of a liquid coating composition, the coating composition must be stable.

Although various primer layers are disclosed in Japanese Laid-Open Patent Publications Nos. 48-47344, 51-114132, 58-95351, etc., those are not entirely satisfactory to the above-mentioned requirements.

We have extensively studied properties of primer materials which may satisfy the above requirements and have found that primer layers which contain a specific copolymerized polyamide are markedly effective for the above described purpose and can be formed with high productivity, and thus completed this invention.

SUMMARY OF THE INVENTION

The gist of the present invention is, in the electrophotographic photosensitive member comprising at least a primer layer and a photosensitive layer formed on a electrically conductive substrate, an improved photosensitive member characterized in that the primer layer contains a copolyamide which contains a diamine constituent represented by a chemical formula

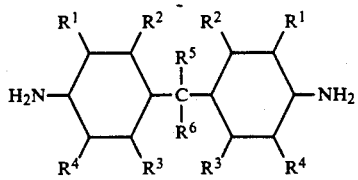

(I)

wherein each of $R^1$, $R^2$, $R^3$, $R^4$, $R^5$, and $R^6$ independently represents a hydrogen atom or a methyl group or an ethyl group, as a constituent thereof.

DETAILED DESCRIPTION OF THE PREFERRED EMBODIMENTS

Now the invention will be specifically described in detail.

The photosensitive member of the present invention comprises an electronically conductive substrate, which can be made of a metallic material such as aluminum, stainless steel, copper, nickel, etc. or may be made of a dielectric material such as a polyester film, paper, glass, etc. on the surface of which an electrically conductive layer of aluminum, copper, palladium, tin oxide, indium oxide, etc. for instance, is provided. A cylinder of a metal such as aluminum is preferred.

A primer layer is provided between the substrate and the photosensitive layer.

The primer layer used in the present invention contains a copolymerized polyamide (hereinafter called "copolyamide") containing a diamine of the above chemical formula as a constituent. The word "constituent" used in this specification means a chain unit in the polyamide, which is derived from a monomer used to form the polyamide. Examples of the copolyamide are: a copolymer, or a multiconstituent polymer such as terpolymer, tetrapolymer, etc. of said diamine constituent, one dicarboxylic acid constituent and at least one other constituent selected from the group consisting of lactam, another dicarboxylic acid, another diamine and piperazine. Examples of the lactam are γ-butyrolactam, ξ-caprolactam, laurolactam. Said dicarboxylic acid and said other dicarboxylic acid should be different from each other and may be respectively selected from the group consisting of 1,4-butanedicarboxylic acid, adipic acid, 1,8-octanedicarboxylic acid, 1,10-decanedicarboxylic acid, 1,12-dodecanedicarboxylic acid, 1,20-eicosanedicarboxylic acid. Said other diamine means a diamine other than the diamine of the above chemical formula and examples thereof are a diamine such as 1,4-butane diamine, 1,6-hexamethylene diamine,1,8-octamethylene diamine, 1,12-dodecane diamine; piperazine, etc.

The ratio of copolymerization is not specifically limited, although said diamine moieties occupy preferable 5–40 mol %, more preferably 5–30 mol %. The method for preparation of the copolyamide is not specifically limited although it is usually prepared by melt polymerization, etc. A monobasic acid such as acetic acid, benzoic acid, etc. or a monoacidic base such as hexylamine, aniline, etc. can be used as a molecular weight regulator in the polymerization.

Further, a thermal stabilizer represented by sodium phosphite, sodium hypophosphite, phosphorous acid, hypophosphorous acid, hindered- phenols, etc. and other additives can be added.

Examples of the copolyamide used in the present invention are as indicated in the following list. In this list, the copolymerization ratio stands for the ratio of the monomers charged in the reactor. In the listed and other chemical formulas, hydrogen atoms of the cyclohexane ring are omitted.

(1)

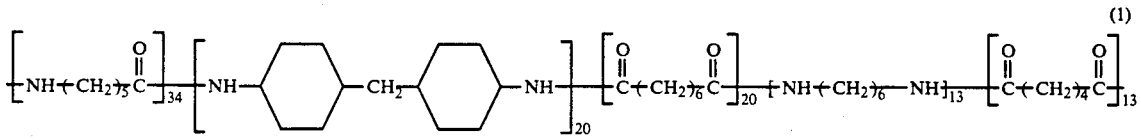

(2)

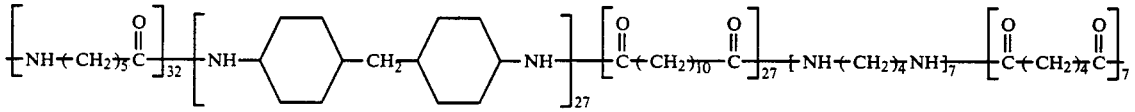

(3)

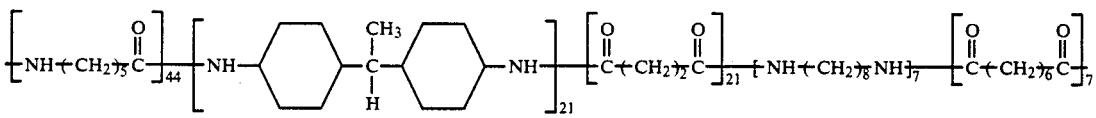

(4)

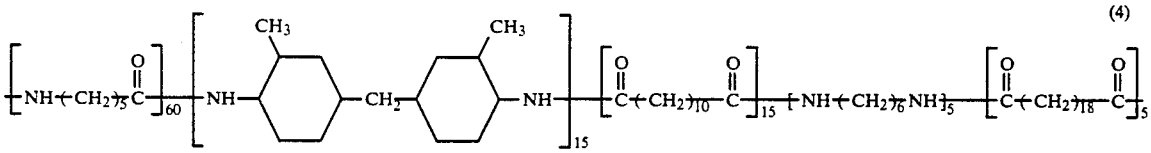

(5)

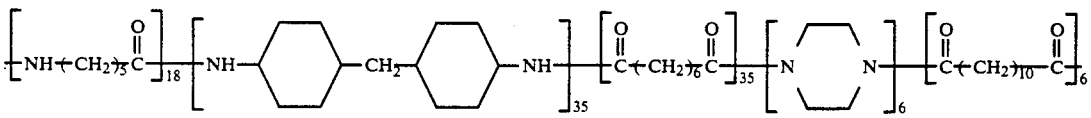

(6)

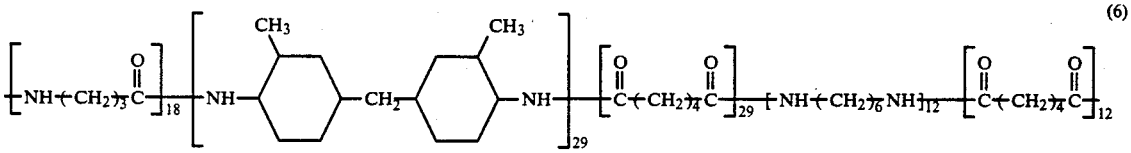

(7)

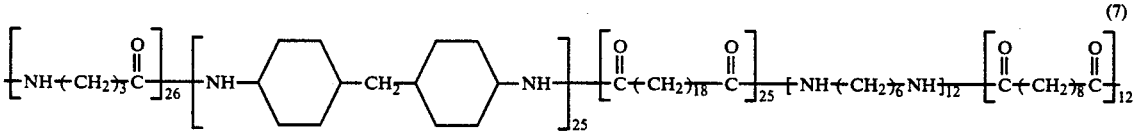

(8)

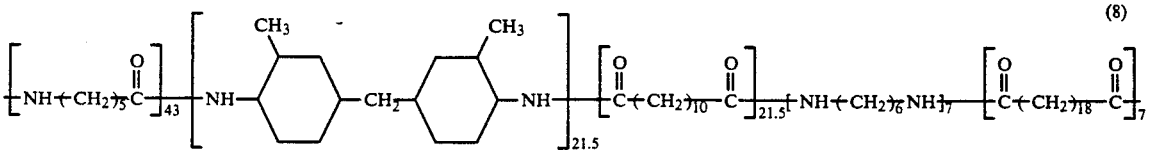

Usually, the monomer ratio of an obtained copolymer is close to the charge ratio of the monomers.

Of the listed copolyamides, particularly preferred are a copolymer represented by a following formula:

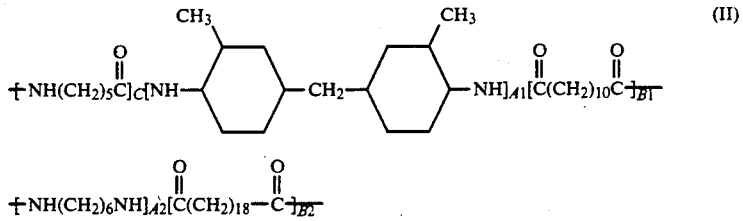

(II)

wherein A1, A2, B1, B2 and C respectively stand for the monomer ratio (in mole), which is usually close to the charge ratio in the copolymerization. The copolymers (4) and (8) represent the above copolymers.

In formula (II), A1, A2, B1, B2 and C satisfy the following conditions:

$$C+A1+A2+B1+B2=100$$

wherein

C=33–67, (A1+A2) is substantially equal to (B1+B2), $A1/(A1+A2)=0.6–1$ and $B1/(B1+B2)=0.6–1$.

Further preferably C=38–60

The method for preparation of such a ternary copolyamide is not specifically limited and ordinary processes for polycondensation of amide such as melt polymerization, solution polymerization, interface polymerization, etc. can be employed. Examples of the starting materials of the ternary polyamide are ε-caprolactam or ε-aminocaproic acid which gives the above-mentioned repeating unit [C], bis(3-methyl-4-aminocyclohexyl)methane which gives the above-mentioned repeating unit [A1], hexamethylenediamine which gives the above-mentioned repeating unit [A2], dodecandioic acid or an ester thereof which gives the above mentioned repeating unit [B1], eicosandioic acid or an ester thereof which giives the above-mentioned repeating unit [B2], etc.

In polymerization, a monobasic acid such as acetic acid, benzoic acid, etc., monoacidic base such as hexylamine, aniline, etc. can be added as a molecular weight regulator.

Further, a thermal stabilizer such as sodium phosphite, sodium hypophosphite, phosphorous acid, hypophosphorous acid, a hindered phenol, etc. and other additives can be added.

The viscosity of the copolyamide is not specifically restricted but suitably decided by considering easiness in handling, use of the product, etc., although it is preferably not less than 1.5, more preferably 1.5–3.5 in relative viscosity ηrel. The term "relative viscosity" here means the relative viscosity determined in accordance with JIS K-6810 with 1% of the polymer concentration in 98% sulfuric acid at 25° C.

The above-described copolyamide is applied to the primer layer in the form of a coating liquid. As solvent therefor, an alcohol such as methanol, ethanol, propanol, butanol, etc.; a ketone such as acetone, methylethylketone, etc.; an aromatic hydrocarbon such as benzene, toluene, etc.; an ester such as methyl acetate, ethyl acetate, etc., halogenated hydrocarbons such as methylene chloride, dichloroethane, trichloroethylene, etc. can be used alone or in combination. From the view point of the stability of the solution, alcohols are preferred.

The primer layer in accordance with the present invention may contain various kinds of additives as desired. Such additives include fine powders of a metal such as aluminum, copper, silver, etc. as an electric resistance regulator; fine particles of a metal oxide such as zinc oxide, titanium oxide, aluminum oxide, indium oxide, tin oxide, silicon oxide, etc., carbon black and a coatability improver such as silicone oil, fluorine-containing surfactants, etc.

The primer layer in accordance with the present invention is most effective when the thickness thereof is 0.05–20 μm more preferably 0.1–10 μm.

The photosensitive layer to be formed on the primer layer as described above may be of either the laminated type or the dispersed type, although the effect of the present invention is markedly manifested when applied to the laminated type.

The term "laminated type" means that the photosensitive layer is composed of a charge generation layer containing a charge generation material and a charge transport layer containing a charge transport material and the term "dispersed type" means that the photosensitive layer is composed of substantially one layer which contains both a charge generation material and a charge transport material.

In so far as a laminated type photosensitive member is concerned, the charge-generation material used in the photosensitive layer is selenium and an alloy thereof, cadmium sulfide, other inorganic photoconductive materials; organic pigments such as phthalocyanine pigments, azo pigments, quinacridone pigments, indigo pigments, perylene pigments, polycyclic quinone pigments, anthanthrone pigments, benzimidazole pigments, etc. The fine powder of these materials is used bonded with a binder such as polyester resins, poly(vinyl acetate), polyacrylates, polymethacrylates, polycarbonates, polyvinylacetoacetal, polyvinylpropional, polyvinylbutyral, phenoxy resins, epoxy resins, urethane resins, cellulose esters, cellulose ethers, etc. The ratio of the charge-generation material to the binder resin is 30–500 parts by weight per 100 parts of the binder. The thickness of the charge generation layer is usually 0.1 m to 1 μm, preferably 0.15 μm to 0.6 μm.

Charge transport materials used in the charge transport layer are, for instance, electron-attracting substances such as 2,4,7-trinitrofluorenone, tetracyanoquinodimethane; electron donors such as heterocyclic compounds such as carbazole, indole, imidazole, oxazole, pyrazole, oxadiazole, pyrazoline, thiadiazole, etc.; aniline derivatives, hydrazone compounds, aromatic amine derivatives, stilbene derivatives, or polymers having a main chain or side chains comprising one of the above-mentioned compounds. The charge transport material is mixed with a binder as required. Preferred binders are vinyl polymers such as poly(methyl methacrylate), polystyrene, poly(vinyl chloride), etc., their copolymers, polycarbonates, polyesters, poly(ester carbonate), polysulfon, polyimide, phenoxy resins, epoxy resins, silicone resins, etc. Partially crosslinked curable products of the above-listed can be also used. The charge transport layer can contain various additives such as antioxidant, sensitizer, etc. as desired. The thickness of the charge transport layer is 5–50 μm, preferably 10–40 μm.

For the dispersed type photosensitive member, the above-described charge-generation materials and charge transport materials are used bonded with a binder resin such as polyester resins, polyacrylates, polymethacrylates, polycarbonates, etc. The charge generation materials are used in an amount of 1–50 parts by weight per 100 parts of the binder resin. The charge transport material is used in an amount of 30–150 parts by weight per 100 parts of the binder resin. The film thickness is usually 5–50 μm, preferably 10–30 μm. The layer may contain various additives such as antioxidant, sensitizer, etc.

The primer coating liquid for the specific copolyamide prepared in accordance with the present invention is excellent in the time-course stability, stability of dispersion containing metal powders when fine powder of a metal is incorporated. Thus, maintenance of the coating solution is easy and coating can be carried out with very high productivity. The humidity-dependability of the electric resistance of the primer layer is low. Therefore, the photosensitive member of the present invention exhibits stable electric characteristics without undergoing reduction of sensitivity and accumulation of residual potential even if after used repeatedly.

The invention will be illustrated by way of working and comparative examples below. However, it will be understood that the invention is not limited thereto.

Preparation of copolyamide (4)

One hundred twenty six grams (126 g) of caprolactam, 67 g of di(3-methy-4-aminocyclohexyl)methane, 64 g of 1,12 dodecanedicarboxylic acid, 13 g of a 80% hexamethylenediamine and 32 g of 1,20-eicosanedicarboxylic acid were placed in an autoclave equipped with a stirrer. Heating was started after the head space was fully replaced with nitrogen. When the inside temperature reached 100° C., stirring was started and heating was continued until the pressure reached 13 kg/cm$^2$. Thereafter, water was distilled off so that the inside pressure was maintained at 13 kg/cm$^2$. Then the valve of the autoclave was closed and the reaction was allowed to continue for 2 hours. Then the valve was opened so as to return the inside pressure to normal pressure. Thereafter, the reaction was further allowed to continue for 2 hours at 290° C. The formed molten polymer was taken out and washed with boiling water of an amount of 10 times the polymer 5 times. The polymer was dried at 120° C. under reduced pressure for 3 days and purified copolyamide was obtained. The copolyamide exhibited a glass transition point of 74° C. and a relative viscosity ( rel) of 1.7. The data obtained by C$^{13}$-NMR corresponded to the structure (4) indicated in the list.

EXAMPLE 1 AND COMPARATIVE EXAMPLE 1

Copolyamide (4) obtained as described above, copolyamide 6/66/12 described below were respectively dissolved in an alcohol mixture (methanol/n-propanol=70/30 by wt %) so as to make 10% solution, which were allowed to stand at 10° C. for 10 days. The solution of copolyamide (4) did not suffer any change but the solutions of copolyamide 6/66/12 became cloudy and gelled next day.

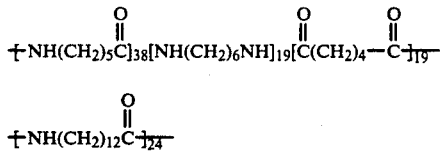

EXAMPLE 2

To an 8% mixed alcohol (methanol/n-propanol=70/30) solution of copolyamide (4) in the list, an 8% mixed alcohol (MeOH/n-propanol=70/30) dispersion of an aluminum oxide powder ("Aluminum Oxide-C" supplied by Nippon Aerosil K.K., average primary particle size: 20 nm), which had been dispersed by means of ultrasonic beforehand, was added and further dispersed by ultrasonic. Thus a primer coating liquid containing 8 wt % solids was prepared. The time-course change of the viscosity of this coating composition was observed in order to check the dispersion stability. No viscosity change was observed after one month. A primer layer was formed on the surface of an aluminum cylinder having a thickness of 1 mm, an outside diameter of 50 mm and a length of 250 mm, said surface having been finished like a mirror, by dipping the cylinder in the coating solution so that a primer layer having a thickness of 1.0 m in the dry state was formed.

Ten (10) parts by weight of oxytitaniumphthalocyanine, 5 parts by weight of polyvinylbutyral ("S-LEC BH-3", supplied by Sekisui Kagaku Kogyo K.K.) and 500 parts by weight of 1,2-dimethoxyethane were placed in a sand grind mill and ground and dispersed. In the thus prepared dispersion, the above-described cylinder having a primer layer was dipped so that a charge generation layer having a thickness of 0.3 m in the dry state was formed.

Then, the cylinder was dipped in a solution containing 56 parts by weight of a hydrazone compound represented by a formula

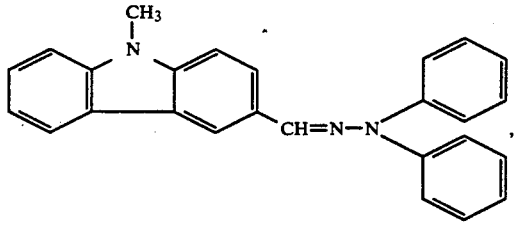

14 parts by weights of a hydrozone compound represented by a formula

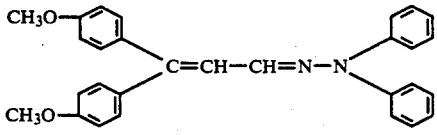

1.5 parts by weight of a cyano compound represented by a formula

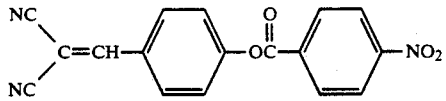

and 100 parts by weight of a polycarbonate resin(viscosity-average molecular weight: 32000) represented by a formula

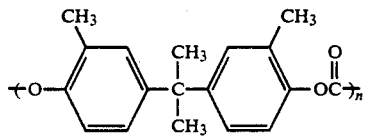

dissolved in 1000 parts by weight of 1,4-dioxane so that a charge transport layer having a thickness of 17 μm in the dry state was formed. The thus prepared drum was designated "photosensitive member A".

COMPARATIVE EXAMPLE 2

The procedures of Example 1 was repeated using the copolyamide 6/66/12 used in Comparative Example 1 as copolyamide and thus a photosensitive member was prepared, which was designated photosensitive member B.

Photosensitive members A and B were mounted on a photosensitive characteristics tester and residual potential Vr was measured when they were charged at a circumferential speed of 63 mm/sec (set to −700 V by a corotron at 25° C. and 60% RH) and exposed (irradiated by light of 3 μJ/cm² intensity) under varied environmental conditions. The results are shown in Table 1 together with sensitivities. Photosensitive member A in accordance with the present invention does not exhibit remarkable drop in sensitivity and remarkable rise in residual potential at low temperature and low humidity. That is, it has very stable electric characteristics (half decay exposure intensity $E_{\frac{1}{2}}$).

TABLE 1

| | | 5° C., 15% | 25° C., 60% | 35° C., 85% |
|---|---|---|---|---|
| Photosensitive member A (Example 2) | $E_{\frac{1}{2}}$(μJ/cm²) | 0.48 | 0.36 | 0.33 |
| | Vr (V) | 75 | 30 | 20 |
| Photosensitive member B (Comp. Ex. 1) | $E_{\frac{1}{2}}$(μJ/cm²) | 0.36 | 0.36 | 0.33 |
| | Vr (V) | 110 | 30 | 20 |

These photosensitive members were mounted on a commercially available laser printer (reverse development type), printing was carried out under various environmental conditions and the formed images were evaluated. Photosensitive member A in accordance with the present invention produced good printed images. In contrast, photosensitive member B showed a tendency of slight drop in image density of the black image portion.

EXAMPLE 3

To an 8% mixed alcohol (methanol/n-propanol=70/30) solution of copolyamide (6) in the list, an 8% mixed alcohol (MeOH/n-propanol=70/30) dispersion of an aluminum oxide powder ("Aluminum Oxide-C" supplied by Nippon Aerosil K.K., average particle size: 20 nm), which had been dispersed by means of ultrasonic beforehand, was added and further dispersed by ultrasonic. Thus a primer coating liquid containing 8 wt % solids was prepared.

A primer layer was formed on the surface of an aluminum cylinder having a thickness of 1 mm, an outside diameter of 80 mm and a length of 340 mm, said surface having been finished like a mirror, by dipping the cylinder in the above described coating liquid so that a primer layer having a thickness of 1.0 m in the dry state was formed.

Ten (10) parts by weight of a bis-azo pigment represented by a formula

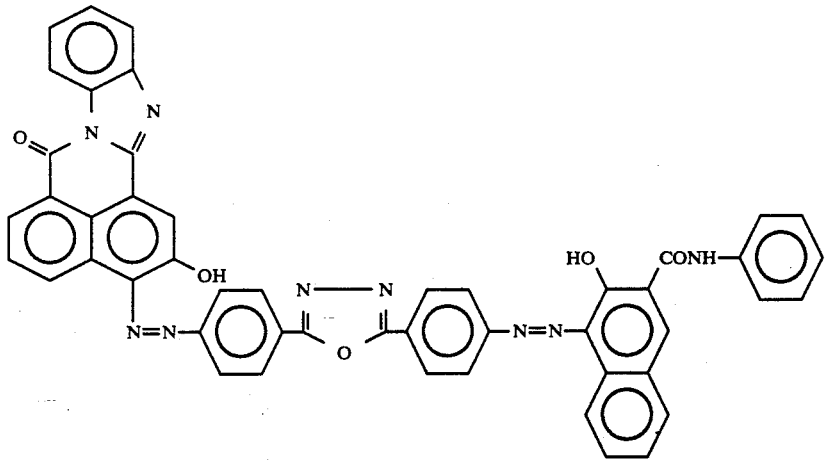

5 parts by weight of polyvinylbutyral ("Denkabutiral #6000C", supplied by Denki Kagaku Kogyo K.K.), and 5 parts by weight of a phenoxy resin ("PKHH" supplied by Union Carbide K.K.) were placed in a sand grind mill and ground and dispersed.

Then, the cylinder having a primer layer was dipped in this dispersion so that a charge-generation layer having a thickness of 0.42 μm in the dry state was formed.

Then, the cylinder was dipped in a solution containing 95 parts by weight of a hydrazone compound represented by a formula

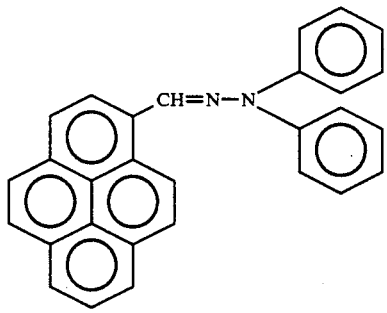

1.5 parts by weight of a cyano compound represented by a chemical formula

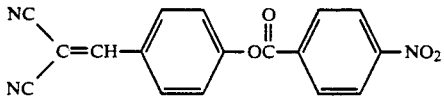

8 parts by weight of 2,6-di-tert-butyl-4-hydroxy-toluene, and 100 parts by weight of a polycarbonate resin (viscosity-average molecular weight: 32000) represented by a formula

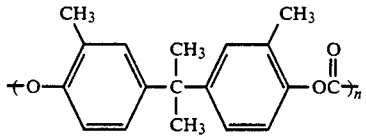

dissolved in 100 parts by weight of 1,4-dioxane so that a charge transportation layer having a thickness of 21 m in the dry state was formed. The thus prepared drum was designated "photosensitive member C".

Photosensitive member C was mounted on a photosensitive characteristics tester and residual potential (Vr) was measured when it was charged at a circumferential speed of 240 mm/sec (set to −700 V by a corotron at 25° C. and 60% RH) and exposed under varied environmental conditions. The results are shown in Table 2 together with sensitivity (half decay exposure intensity) of the photosensitive member. Photosensitive member C in accordance with the present invention do not exhibit remarkable drop in remarkable rise in residual potential at low temperature and low humidity like photosensitive member A.

TABLE 2

| | | 5° C., 15% | 25° C., 60% | 35° C., 85% |
|---|---|---|---|---|
| Photosensitive member C (Example 3) | $E_{\frac{1}{2}}$(lux sec) | 0.88 | 0.88 | 0.89 |
| | Vr (Volt) | 61 | 30 | 28 |

EXAMPLE 4

The procedures of Example 2 were repeated using copolyamide (8) ($\eta$rel=1.54 and photosensitive member D was prepared.

Sensitivity (half decay exposure intensity) and residual potential of photosensitive member D were measured and produced image was evaluated. From photosensitive member D, printed images having stable electric characteristics were consistently obtained like from photosensitive member A.

What we claim is:

1. In the photosensitive member for electrophotography comprising at least a primer layer and a photosensitive layer formed on an electrically conductive substrate, an improved photosensitive member characterized in that the primer layer contains a copolyamide which is represented by a chemical formula (II)

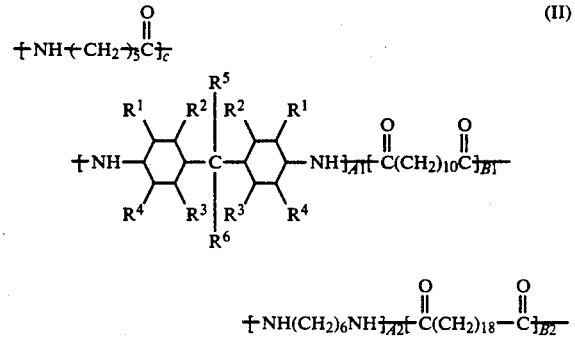

wherein each $R^1$, $R^2$, $R^3$, $R^4$, $R^5$ and $R^6$ represents independently a hydrogen atom or a methyl or ethyl group; and A1, A2, B1, B2 and C represent the monomer ratio and satisfy the following relations:

C=33–67, (A1+A2) is substantially equal to (B1+B2), $A1/(A1+A2)=0.6–1$ and $B1/(B1+B2)=0.6–1$ wherein $A1+A2+B1+B2+C=100$ and all monomers represented by the A1, A2, B1, B2 and C ratios are present in said copolyamide.

2. The photosensitive member for electrophotography as claimed in claim 1, wherein the electrically conductive substrate is made of a material selected from a group consisting of a metal and polyester, paper and glass on the surface of which an electrically conductive layer is provided.

3. The photosensitive member as claimed in claim 1, wherein the diamine monomer constituent represented by ratio A1 of said copolyamide of formula (II) is one selected from a group consisting of:

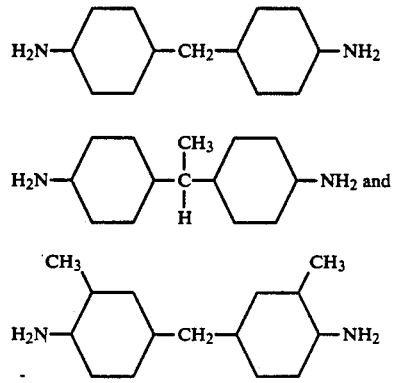

4. The photosensitive member of claim 3, wherein the diamine monomer constituent represented by ratio A1 of said copolyamide of formula (II) is di(3-methyl-4-amine-cyclohexyl) methane.

5. The photosensitive member for electrophotography as claimed in claim 1, wherein the primer layer has a thickness of 0.05–20 μm.

6. The photosensitive member for electrophotography as claimed in claim 1, wherein the primer layer contains one or more additives selected from a group consisting of fine particles of metal, fine particles of a metal, fine particles of a metal oxide, carbon black, silicone and a fluorine-containing surfactant.

7. The photosensitive member for electrophotography as claimed in claim 1, wherein the photosensitive layer is of the laminated type composed of a charge generation layer and a charge transport layer.

8. The photosensitive member for electrophotography as claimed in claim 7, wherein the thickness of the charge generation layer of the photosensitive layer is 0.1–1 μm.

9. The photosensitive member for electrophotography as claimed in claim 1, wherein the photosensitive layer is claimed in claim 1, wherein the photosensitive layer is of the dispersed type.

10. The photosensitive member for electrophotography as claimed in claim 7, wherein the thickness of the charge transport layer is 5–50 μm.

11. The photosensitive member for electrophotography as claimed in claim 7, wherein a charge generation material of the charge generation layer is one or more selected from a group consisting of selenium, selenium alloys and cadmium sulfide, phthalocyanine pigments, azo pigments, quinacridone pigments, indigo pigments, perylene pigments, polycyclic quinone pigments, anthantrone pigments and benzimidazole pigments.

12. The photosensitive member for electrophotography as claimed in claim 7, wherein a charge transport material of the charge transport layer is one or more than one selected from a group consisting of 2,4,7-trinitrofluorenone, tetracyanoquinodimethane, carbazole, indole, imidazole, oxazole, pirrazole, oxadiazole, pirrazoline, thiadiazole, aniline derivatives, hydrazone compounds, aromatic amine derivatives, stilbene derivatives and polymers having groups comprising any of the above compounds in the chain or side chain.

13. The photosensitive member for electrophotography as claimed in claim 9, wherein the photosensitive layer contain one or more charge generation material selected from a group consisting of selenium, selenium alloys, cadmium sulfide, phthalocyanine pigments, azo pigments, quinaclidone pigments, indigo pigments, perylene pigments, polycyclic quinone,,pigments, anthanthrone pigments and benzimidazole pigments, one or more charge transport material selected from a group consisting of 2,4,7-trinitrofluorenone, tetracyanoquinodimethane, carbazole, indole, imidazole, oxazole, pirrazole, oxadiazole, pirrazoline, thiadiazole, aniline derivatives, hydrazone compounds, aromatic amine derivatives, stilbene derivatives and polymers having groups comprising any of the above compounds in the chain or side chain.

* * * * *